US006742467B2

(12) United States Patent
Kong

(10) Patent No.: US 6,742,467 B2
(45) Date of Patent: Jun. 1, 2004

(54) APPARATUS AND METHOD FOR CONTROLLING FEED QUANTITY AND DIRECTION IN SEWING MACHINE

(75) Inventor: Byoung Min Kong, Inchon (KR)

(73) Assignee: Sunstar Machinery Co., Ltd., Inchon (KR)

( * ) Notice: Subject to any disclaimer, the term of this patent is extended or adjusted under 35 U.S.C. 154(b) by 0 days.

(21) Appl. No.: 10/393,246

(22) Filed: Mar. 21, 2003

(65) Prior Publication Data

US 2003/0177972 A1 Sep. 25, 2003

(30) Foreign Application Priority Data

Mar. 21, 2002 (KR) ..... 10-2002-0015379

(51) Int. Cl.[7] ..... D05B 19/16

(52) U.S. Cl. ..... 112/470.04; 112/316; 112/475.19

(58) Field of Search ..... 112/470.04, 470.01, 112/470.06, 102.5, 316, 317, 475.05, 475.19; 700/138, 136

(56) References Cited

U.S. PATENT DOCUMENTS 4,693,192 A * 9/1987 Yasui ..... 112/470.02
4,870,916 A * 10/1989 Kozawa et al. ..... 112/470.02

* cited by examiner

*Primary Examiner*—Peter Nerbun
(74) *Attorney, Agent, or Firm*—Staas & Halsey LLP

(57) ABSTRACT

Disclosed is an apparatus and method for controlling feed quantity and direction in a sewing machine, in which feed quantity and direction of a workpiece is controlled by a motor, thereby not only allowing various patterns to be produced by stitches made up of upper and lower threads, but also allowing a speedy sewing operation. The apparatus comprises an operator interface means for inputting the feed quantity and direction of a workpiece according to an operator's plan, a motor driving control means for outputting a motor driving control signal according to feed information on the feed quantity and direction of the workpiece inputted through the operator interface means, and a workpiece feed control means for controlling rotation direction and speed of the motor according to the motor driving control signal from the motor driving control means.

15 Claims, 10 Drawing Sheets

FIG, 6

APPARATUS AND METHOD FOR CONTROLLING FEED QUANTITY AND DIRECTION IN SEWING MACHINE

BACKGROUND OF THE INVENTION

1. Field of the invention

The present invention relates to an apparatus and method for controlling feed quantity and direction in a sewing machine, and more particularly to an apparatus and method for controlling feed quantity and direction of a workpiece using a motor, thereby not only allowing various patterns to be produced by stitches made up of an upper thread and a lower thread, but also allowing for a speedy sewing operation.

2. Description of the Prior Art

FIG. 1 is an exploded perspective view showing an apparatus for controlling feed quantity and direction in accordance with the prior art.

As shown in FIG. 1, conventionally, a change in the feed quantity caused by a feed dog 10 is controlled by changing a mechanical construction in such a manner that a feed regulating dial 12 is turned in a clockwise or counterclockwise direction. Further, a change in the feed direction is controlled by rotating a reverse regulating lever shaft 32 by a given angle in such a manner that either a reverse lever 13 or a reverse operation lever 50 (see FIG. 2) is pushed to drive a reverse solenoid 54 (see FIG. 2).

When the feed regulating dial 12 is turned in a clockwise or counterclockwise direction, a feed regulating dial shaft 14, which is engaged to the feed regulating dial 12, is rotated to move in a forward or backward direction. There is a threaded groove formed around the feed regulating dial shaft 14. The feed regulating dial shaft 14 is rotatably supported to an arm, which is not shown, and comes into contact with a feed regulating cam 16. Therefore, as the feed regulating dial 12 rotates, the feed regulating dial shaft 14 moves in a forward or backward direction and at the same time the feed regulating cam 16 rotates, so that a feed regulating cam connecting rod 18, which is pivotably connected to one end of the feed regulating cam 16, moves in an upward and downward direction.

When the feed regulating cam connecting rod 18 moves in an upward and downward direction, a feed regulating lever 20, which is connected to the other end of the feed regulating cam connecting rod 18 and is fixedly coupled around a reverse regulating lever shaft 32, rotates about the reverse regulating lever shaft 32. As a result, a condense regulator 24, which is fixedly coupled to the reverse regulating lever shaft 32 together with the feed regulating lever 20, also rotates In the same direction as the feed regulating lever 20.

When the condense regulator 24 rotates, a condense regulating rod 26, which is connected to the condense regulator 24, moves in a direction opposite to the feed regulating cam connecting rod 18. For instance, when the condense regulator 24 rotates in a clockwise direction, the condense regulating rod 26 moves in an upward direction, while the feed regulating cam connecting rod 18 moves in a downward direction. When an upward movement force of the condense regulating rod 26 is transmitted to a feed regulator shaft 28, the feed regulator shaft 28 is subjected to a change in a stationary angle. With the change in the stationary angle of the feed regulator shaft 28, the feed dog 10 is subjected to a change in feed quantity.

A description will be made below regarding a mechanism in which the feed dog 10 is fed according to controlled feed quantity.

As shown in FIG. 1, a feed regulator shaft 28 is connected to a feed regulator shaft connecting rod 30. The feed regulator shaft connecting rod 30 is connected to a feed cam connecting rod 36 and a feed rocker crank 33. Here, power, which is transmitted from a feed cam connecting rod 36 through the feed regulator shaft connecting rod 30 to the feed rocker crank 33, functions as a driving force allowing for movement of the feed dog 10 in a forward or backward direction. An eccentric part 44 functions as a driving source, which is formed on one end of a lower driving shaft 42 and causes a feed dog base connecting rod 46 to move in an upward and downward direction while the lower driving shaft 42 rotates. At the same time, a feed dog base 48, which is pivotably connected with the feed dog base connecting rod 46, moves in an upward and downward direction, and thereby the feed dog 10, which is attached on the upper surface of the feed dog base 48, moves in an upward and downward direction.

Subsequently, a detailed description will be made regarding a forward/backward movement transmission and an upward/downward movement transmission of the feed dog 10. The feed regulator shaft connecting rod 30 comprises a first section which is connected to the feed regulator shaft 28 and carries out a sliding motion depending on the stationary angle of the feed regulator shaft 28, a second section which is fixed to the feed cam connecting rod 36 cooperating with the feed cam 34 with the lower driving shaft 42 and carries out a fluctuating motion, and a third section which is connected to the feed rocker crank 33 fixed to a horizontal rolling pin 38 and functions as a driving source of a feed bracket 40 fixed to a horizontal rolling pin 38.

When the feed regulator shaft 28 has a constant angle, the lower driving shaft 42 receiving a rotating force from an upper driving shaft rotates. At this time, the feed cam connecting rod 36, which is connected to the feed cam 34 connected to the lower driving shaft 42 and performs an eccentric motion, moves in an upward and downward direction. The first section of the feed regulator connecting rod 30 connected to the feed regulator shaft 28 moves uniformly in an upward/downward direction and at the same time in an forward/backward direction, as shown in FIGS. 3A and 3B. Here, when the feed regulator shaft 28 is vertically fixed, the feed regulator shaft connecting rod 30 may not move in the forward/backward direction.

Therefore, the feed regulator shaft connecting rod 30 connected to the feed rocker crank 33 fluctuates in a forward/backward direction, so that the feed bracket 40 also fluctuates in a forward/backward direction. Further, the feed dog 10 moves an elliptical motion owing to an upward/downward movement transmitted from the feed cam 34 and an forward/backward movement transmitted from the feed bracket 40, as shown in FIGS. 4A to 4D. As a result, the workpiece is fed across the feed dog.

To be more specific, when an operator rotates the feed regulating dial 12 in a direction from "2.5" to "0", a rotating force is transmitted, through the movement transmission mechanism, such as the feed regulating cam 16, feed regulator connecting rod 18, feed regulating lever 20, condense regulator 24 and condense regulating rod 26, to the feed regulator shaft 28. As a result, the stationary angle of the feed regulator shaft 28 is changed. When the feed regulating dial 12 is set to "0", the rotating force, which is transmitted through the movement transmission mechanism to the feed regulator shaft 28, causes the stationary angle of the feed regulator shaft 28 to be stopped at an angle of zero degrees. Further, the feed dog 10 reciprocates in an upward/downward direction without fluctuating in a forward/backward direction.

Subsequently, an apparatus for controlling feed direction will be described. The apparatus for controlling feed direction comprises the same mechanism as the apparatus for controlling feed quantity. In other words, the apparatus for controlling feed direction has a construction which is very similar to that of the apparatus for controlling feed quantity shown in FIG. 1 as mentioned above. In particular, both apparatuses have completely the same power transmission mechanism next to the feed regulator shaft 28. Therefore, the following description regarding an operation of the apparatus for controlling a feed direction will be made only on the basis of differences from the apparatus for controlling feed quantity. When an operator presses down the reverse lever 13, the reverse regulating lever shaft 32 fastened to the reverse lever 13 by a fastening screw 15 rotates. Here, the reverse regulating lever shaft 32 rotates similarly to the feed regulating dial 12 functioning in the apparatus for controlling feed quantity, being turned in a clockwise or counterclockwise direction. As a result, a rotating movement of the reverse regulating lever shaft 32 is transmitted through the condense regulating rod 26 to the feed regulator shaft 28. In this case, a difference between the pressing of the reverse lever 13 and the turning of the feed regulating dial 12 is the movement range of the feed regulator shaft 28. To be more specific, when the feed regulating dial 12 is turned, the feed regulator shaft 28 performs a stepwise rotating movement, so that the movement range of the feed regulator shaft 28 is provided between the "zero" feed quantity and the "maximum" feed quantity.

However, when the reverse lever 13 is pressed, the feed regulator shaft 28 is adapted to move after it rotates through the zero point as its "zero" feed quantity up to the maximum movement point, where the zero point refers to a stationary angle of the feed regulator shaft 28, at which, after the feed quantity is set as a "zero" value, the feed regulator shaft 28 causes the feed dog 10 to move in an upward/downward direction at roughly the original operating position.

For example, when the reverse lever 13 is pressed after the progressive feed quantity is set to "0", the stationary angle of the feed regulator shaft 28 is not changed. However, when the reverse lever 13 is pressed after the progressive feed quantity is set to "2.0 mm", the feed regulator shaft 28 rotates through the zero point up to the stationary angle corresponding to the "2.0 mm" value. Therefore, the feed regulator shaft connecting rod 30 connected to the feed regulator shaft 28 also moves in a forward/backward direction, so that the feed direction is changed. In this case, a condense regulating dial 11 must have a scale of 2.0 mm.

That is to say, under the preposition that the feed regulating dial 12 controlling the progressive feed quantity has a scale of 2.0 mm, when the condense regulating dial 11 limiting a reverse feed quantity has a scale of "0 (zero)", the feed regulator shaft 28 maintains a stationary angle at the zero point thereof even if the reverse lever 13 is pressed. Further, when the condense regulating dial has a scale of 2.5 mm, the feed regulator shaft 28 maintains a vertical angle corresponding to the reverse feed quantity of 2.5 mm beyond the zero point.

Now, a description will be made regarding the apparatus controlling feed direction using a (semi-automated) reverse operating lever 50 with reference to FIG. 2.

When an operator operates the semi-automated reverse operating lever 50, a reverse button switch 52 is turned on to supply an electric signal to a reverse solenoid 54. Therefore, the reverse solenoid 54 is driven.

Subsequently, a driving force of the reverse solenoid 54 is transmitted to a reverse lever bracket 56 connected to the reverse solenoid 54, a reverse lever connecting link 57, a revere lever connecting bracket 58 and the reverse regulating lever shaft 32 (FIG. 1). The driving is then transmitted through the feed regulating lever 20, the condense regulator 24 and the condense regulating rod 26 (FIG. 1) to the feed regulator shaft 28 (FIG. 1).

The driving force transmitted in this manner forces the feed direction to be changed. When the reverse operating lever 50 is released, the reverse button switch 52 is turned off by a restoring force from a reverse operating lever spring 60, and then the electric signal supplied to the reverse solenoid 54 is cut off to stop the reverse solenoid 54. As a result, the reverse regulating lever shaft 32 (FIG. 1) rotates in a reverse direction, so that the feed regulator shaft 28 is returned to a position as when a forward feed is carried out.

As mentioned above, in the conventional apparatus for controlling feed quantity, there are disadvantages in that the apparatus is provided with additional components, such as the reverse lever 13, the reverse operating lever 50 and so forth, and moreover that the feed regulating dial must be manually turned by an operator during operation of the reverse solenoid 54 which is regarded to be unnecessary.

There is another disadvantage in that the operator turns the feed regulating dial 12 while seeing scales marked off by 0.5 mm increments, so that it is impossible to carry out a precise controlling operation.

Further, when a reverse lever is incorpoarted, the number of components is increased for obtaining a mechanism, and an unwanted space is needed during power transmission. Therefore, such a sewing machine has a complicated construction.

Further, response speed, which changes the feed direction, amounts to about 1000 rpm due to a property of the reverse solenoid. This acts as a great disadvantage on an industrial sewing machine which must be operated at a speed of 4500 rpm or more.

Additionally, when reverse operation is repeatedly performed, the reverse solenoid is overloaded, generating errors in that correct power transmission is not carried out and the reverse solenoid is not operated.

SUMMARY OF THE INVENTION

Accordingly, the present invention has been made to solve the above-mentioned problems occurred in the prior art, and an object of the present invention is to provide an apparatus and method for controlling feed quantity and direction in a sewing machine, in which feed quantity and direction of a workpiece are controlled using a motor, thereby not only allowing various patterns to be produced by stitches made up of upper and lower threads, but also allowing a speedy sewing operation.

It is another object of the present invention to provide an apparatus and method for controlling feed quantity and direction in a sewing machine, in which the feed quantity of a workpiece is controlled using a motor, and thereby the feed quantity can be more precisely controlled.

To achieve the above and other objects of the present invention, there is provided an apparatus for controlling feed quantity and direction in a sewing machine, the apparatus comprising: an operator interface means for inputting the feed quantity and direction of a workpiece; a motor driving control means for outputting a motor driving control signal according to feed information on the feed quantity and direction of the workpiece inputted through the operator interface means; and a workpiece feed control means for controlling rotation direction and speed of the motor according to the motor driving control signal from the motor driving control means.

It is characterized in that the sewing machine performs a sewing operation in a zigzag form while a needle bar reciprocates in an x-axis direction.

It is characterized in that the apparatus further comprises a sensing means for checking whether or not the motor is being driven and feeding the checked result back to the motor driving control means, so as to check whether or not the motor is being driven based on the feed information and correct a driving condition of the motor.

It is characterized in that the operator interface means comprises: an input section for inputting the feed quantity of the workpiece according to the operator's plan; a select section for inputting the feed direction of the workpiece; and a display section for displaying feed information on the workpiece inputted through the input and select sections on a screen.

It is characterized in that the feed quantity of the workpiece inputted into the input section includes at least one of a progressive feed quantity and a reverse feed quantity.

It is characterized in that the motor driving control means comprises: a first control section for generating the feed information according to the feed quantity and direction of the workpiece; and a second control section for receiving the feed information by communicating with the first control section and outputting the motor driving control signal based on the feed information.

Further, it is characterized in that the motor driving control means generates a control signal for converting a position of the motor into a reference position, before generating the control signal for converting the position of the motor in response to the feed information.

It is characterized in that the feed information is stitch width information.

To achieve the above and other objects of the present invention, there is provided a method for controlling feed quantity and direction in a sewing machine, the method comprising steps of: recognizing feed quantity and direction of a workpiece inputted according to an operator's plan; and generating feed information on the feed quantity and direction of the workpiece and controlling rotation direction and speed of a motor in response to the feed information.

It is characterized in that the method further comprises a sensing step, the sensing step being carried out by sensing whether or not the motor is being driven, feeding the sensed result back to the controlling step, checking whether or not the motor is being driven based on the feed information, and correcting a driving condition of the motor.

It is characterized in that the feed quantity of the workpiece inputted into the input section includes at least one of a progressive feed quantity and a reverse feed quantity.

It is characterized in that the controlling step further comprises a step of converting a position of the motor into a reference position, before converting the position of the motor in response to the feed information.

It is characterized in that the controlling step comprises a step of providing a correction set mode for allowing the feed information preset by the operator to be changed into desired feed information and restoring the changed resultant.

It is characterized in that the feed information is stitch width information.

The present invention is directed to propose an apparatus for controlling feed quantity and direction using a motor in a sewing machine which rotates a reverse lever shaft using the motor and a timing belt instead of rotating a feed regulating dial and includes a power transmission mechanism for connecting the reverse lever shaft, a condense regulator, a feed regulator shaft, a feed regulator shaft connecting rod, a feed rocker crank, a feed rocker bracket, a feed dog base and a feed dog. The present invention employs a mode for controlling feed quantity and direction by means of an electro-electrical mechanism using a control means and a motor, instead of controlling feed quantity and direction by means of a mechanical mechanism.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to the accompanying drawings.

Figure 5:
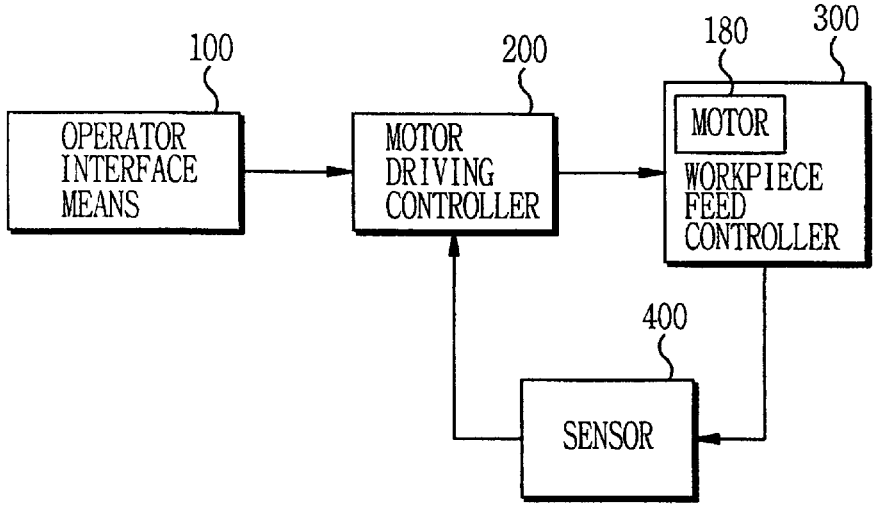
FIG. 5 is a block diagram showing a construction of an apparatus for controlling feed quantity and direction in a sewing machine according to a first embodiment of the present invention.
Figure 6:
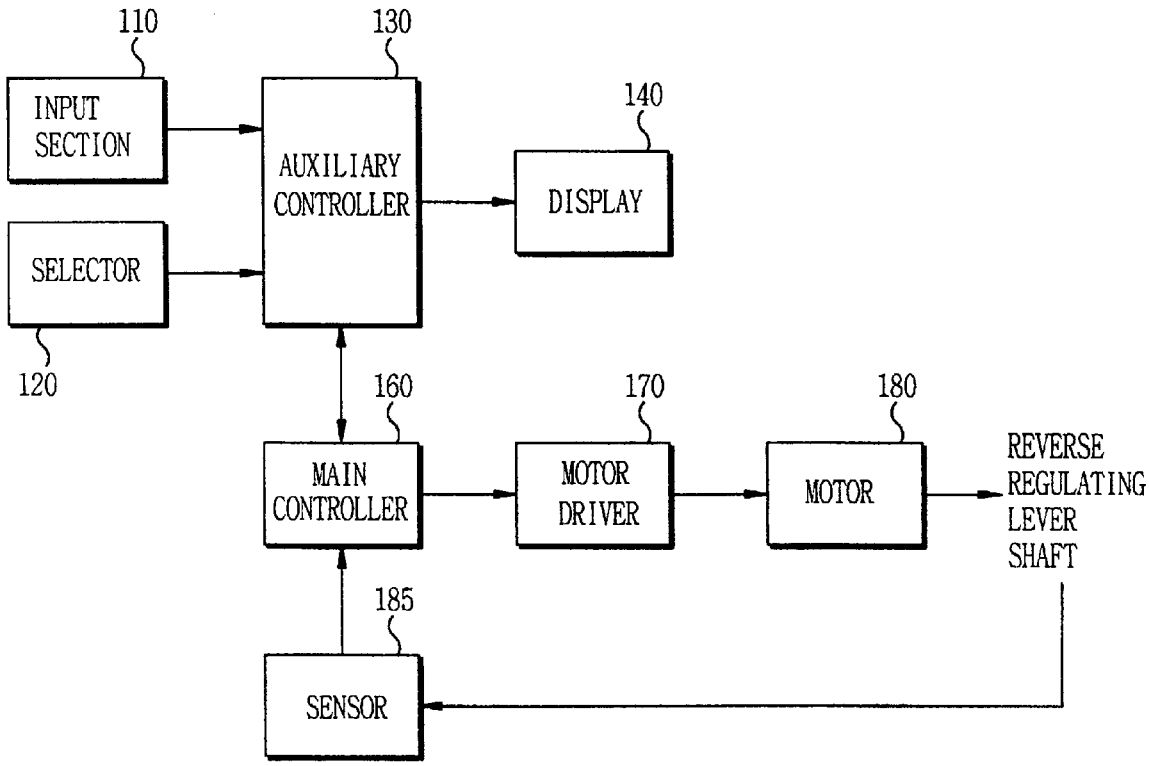
FIG. 6 is a block diagram showing a construction of an apparatus for controlling feed quantity and direction in a sewing machine according to a second embodiment of the present invention.
Figure 7:
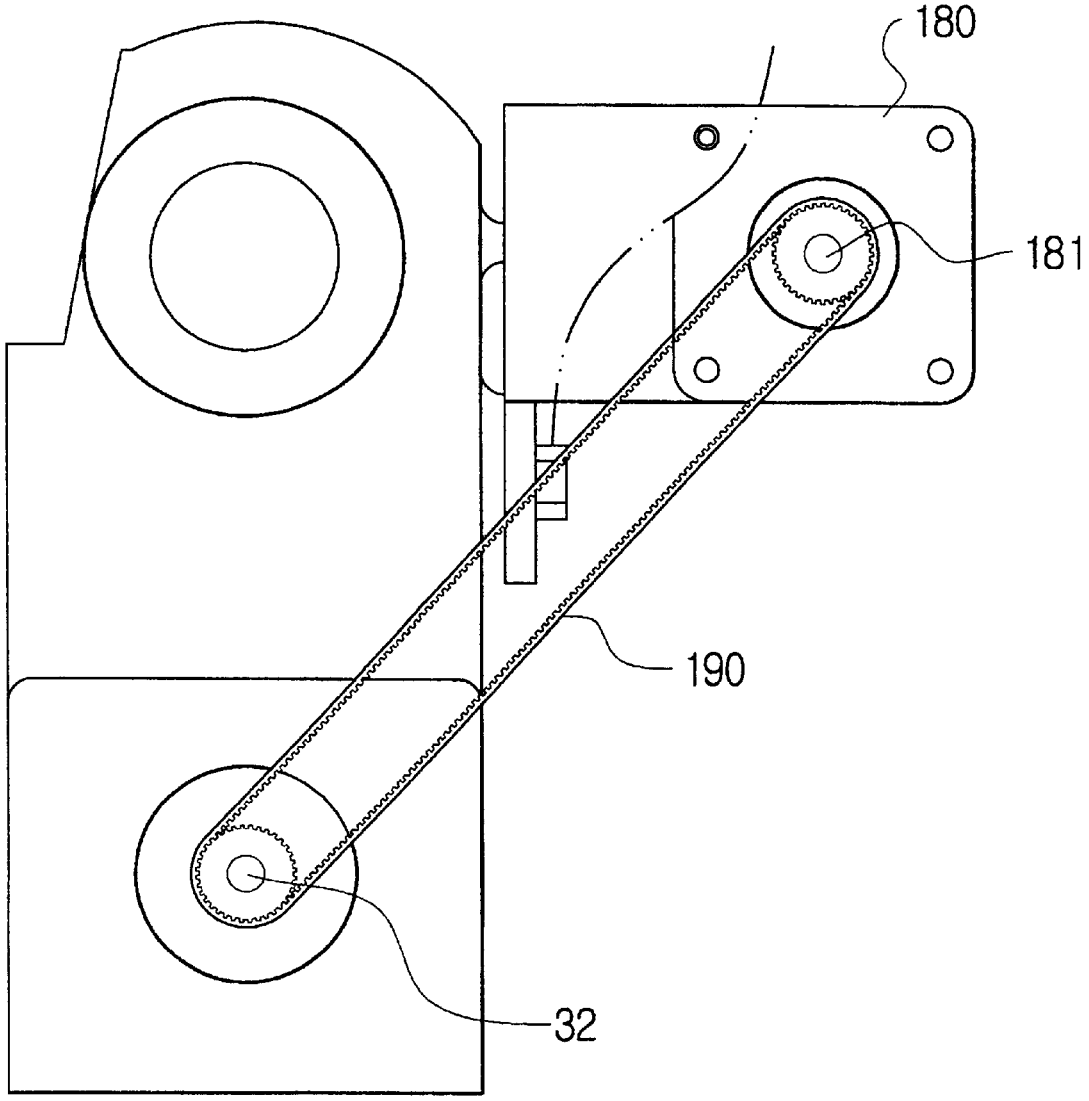
FIG. 7 is a side view showing a construction in which a motor is connected to a reverse regulating lever shaft in accordance with the present invention.

FIG. 5 is a block diagram for explaining a construction of an apparatus for controlling feed quantity and direction in a sewing machine according to a first embodiment of the present invention, FIG. 6 is a block diagram showing an apparatus for controlling feed quantity and direction in a sewing machine according to a second embodiment of the present invention, and FIG. 7 is a side view showing a construction in which a motor is connected to a reverse regulating lever shaft in accordance with the present invention.

As shown in FIG. 5, an apparatus for controlling feed quantity and direction in a sewing machine comprises an operator interface means 100 for receiving feed quantity and direction of a workpiece according to an operator's plan, a motor 180 connected to a reverse regulating lever shaft 32 (FIG. 7) by means of a timing belt 190 (FIG. 7), a motor driving controller 200 for generating feed information based on the feed quantity and direction to output a motor driving control signal based on the feed information, a workpiece feed control means 300 for controlling rotating direction and speed of the motor 180 in response to the motor driving control signal, and a sensor 400 for checking whether or not the motor 180 is driven and feeding the checked result back to the motor driving controller 200. A sensing signal outputted from the sensor 400 allows the motor driving controller 200 to check whether or not the motor 180 is driven based on the feed information and to correct a driving condition of the motor 180.

FIG. 6 is a block diagram showing a construction of an apparatus for controlling feed quantity and direction in a sewing machine according to a second embodiment of the present invention. In FIG. 6, an input section 110 is for inputting feed quantity of a workpiece according to an operator's plan, and a selector 120 is for inputting a feed direction of a workpiece according to an operator's plan. A display 140 is for displaying feed information on the workpiece inputted by an operator on a screen.

The operator may input a progressive feed quantity or a reverse feed quantity through the input section 110. The selector 120 makes use of an ON/OFF switch. When the selector 120 is set to an ON state, a sewing operation is controlled to carry out in a forward direction by an auxiliary controller 130. However, when the selector 120 is set to an OFF state, a sewing operation is controlled to carry out in a backward direction by an auxiliary controller 130.

The auxiliary controller 130 generates feed information (specifically, stitch width information) according to feed quantity and direction of the workpiece. A main controller 160 receives the information by communicating with the auxiliary controller 130 and outputs a motor driving control signal based on the feed information.

The main controller 160 outputs the motor driving control signal to a motor driver 170. Here, before changing the present position of the motor 180, the motor driving control signal is outputted as a control signal for converting the present position of the motor 180 into a reference position. The main controller 160 provides a correction set mode for allowing the feed information preset by the operator to be changed into desired feed information and restoring the changed resultant.

The motor driver 170 drives the motor 180 according to the motor driving control signal from the main controller 160.

FIG. 7 is a side view showing a construction in which a driving motor 180 is connected to a reverse regulating lever shaft 32 in accordance with an embodiment of the present invention. As shown in FIG. 7, a reverse regulating lever shaft 32 and a shaft 181 of the driving motor 180 are each provided with a pulley. The pulley is engaged with a timing belt 190. Therefore, when the motor 180 is driven, a driving force of the motor 180 is transmitted through the timing belt 190 to the reverse regulating lever shaft 32.

The present invention is applied not only to a sewing machine in which a sewing operation is carried out while a needle bar reciprocates in an x-axis direction, but also to a sewing machine in which feed quantity and direction are controlled using a motor.

A method for controlling feed quantity and direction in a sewing machine constructed as mentioned above is described with reference to FIGS. 5 to 11.

Figure 8:
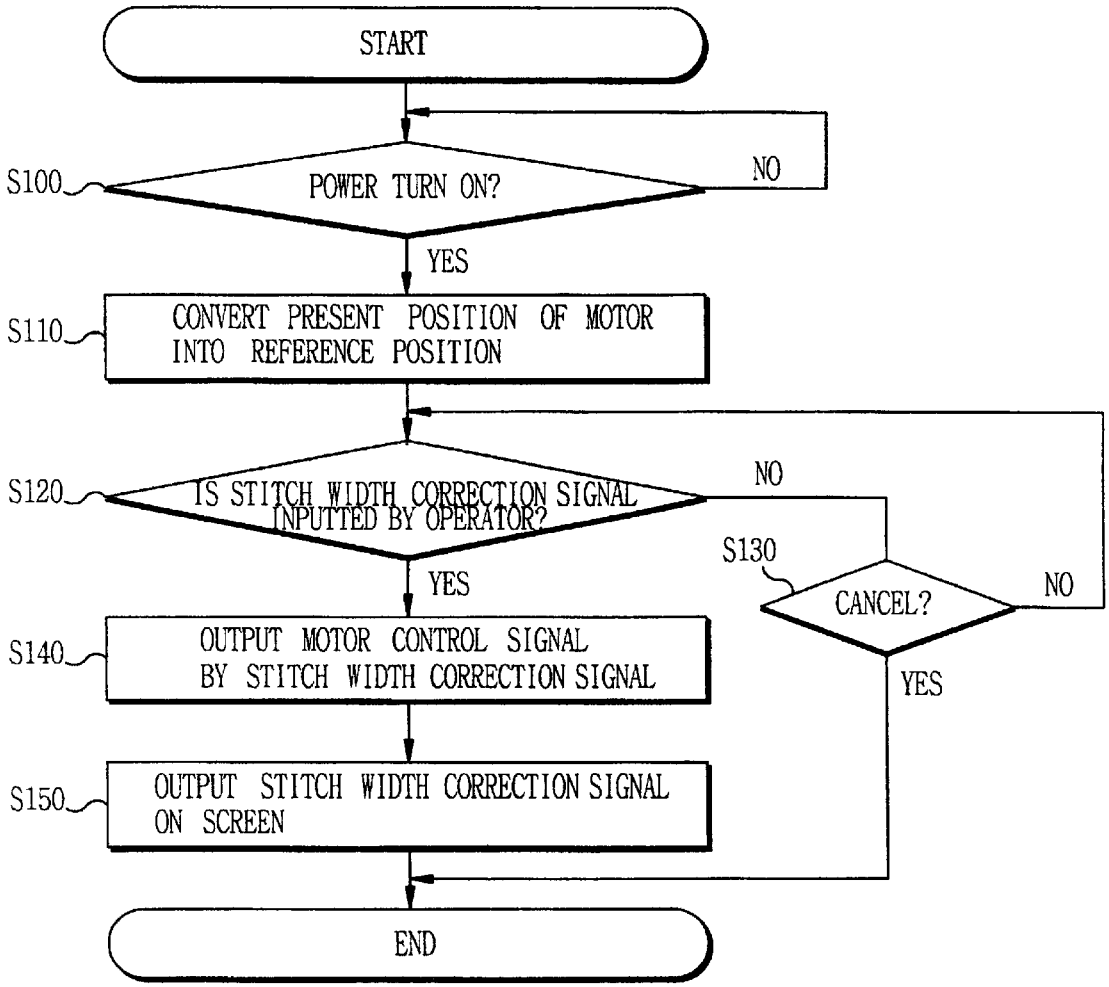
FIG. 8 is an operation flow chart for explaining a method for setting feed quantity using a motor in a sewing machine of the present invention.
Figure 9:
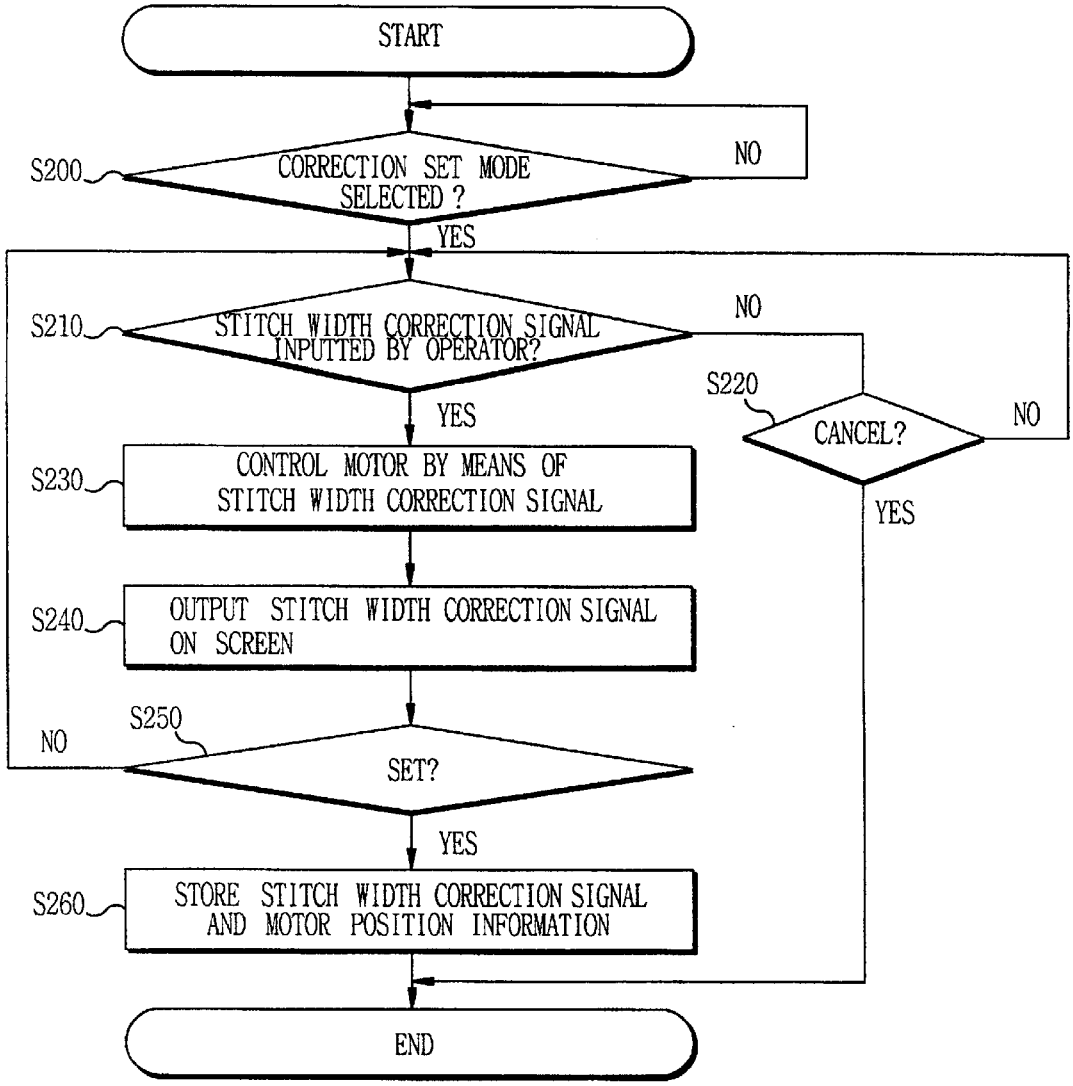
FIG. 9 is an operation flow chart for explaining a method for correcting feed quantity using a motor in a sewing machine of the present invention.
Figure 10:
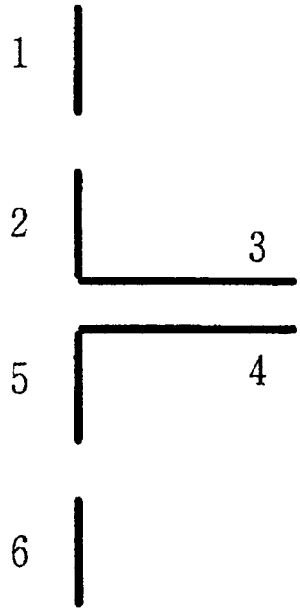
FIG. 10 shows an L-stitch capable of being sewn by a sewing machine of the present invention.
Figure 11:
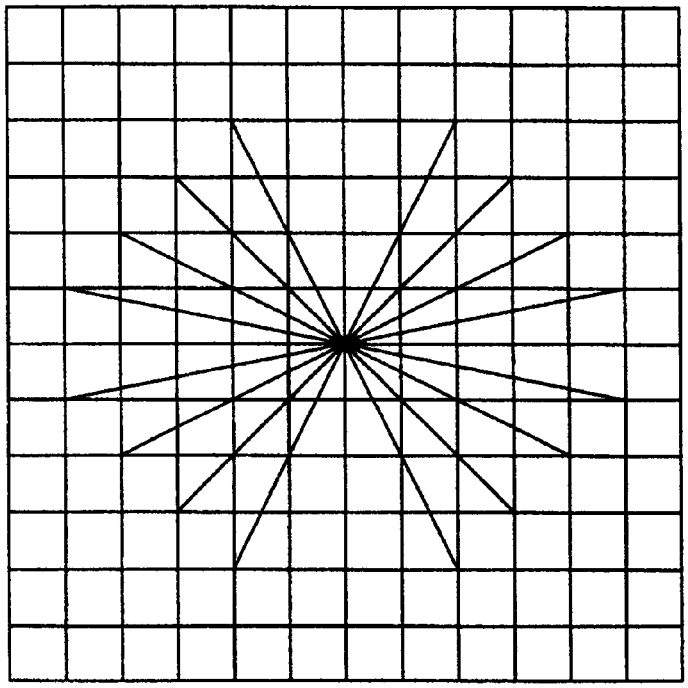
FIG. 11 shows a radial pattern capable of being sewn by a sewing machine of the present invention.

FIG. 8 is an operation flow chart for explaining a method for setting feed quantity using a motor in a sewing machine of the present invention. FIG. 9 is an operation flow chart for explaining a method for correcting feed quantity using a motor in a sewing machine of the present invention. FIG. 10 shows an L-stitch capable of being sewn by a sewing machine of the present invention. FIG. 11 shows a radial pattern capable of being sewn by a sewing machine of the present invention.

First, a description will be made regarding a method for controlling feed quantity with reference to FIG. 8. When an operator manipulates the sewing machine to power on (S100), the auxiliary controller 130 generates and outputs a feed information signal related to a feed direction. When the feed information signal is inputted from the auxiliary controller 130, the main controller 160 converts a present position of the motor 180 into a reference position, and then outputs a change completion signal, which indicates the change in the reference position of the motor, to the auxiliary controller 130 (S110).

The auxiliary controller 130 determines whether or not a stitch width correction signal is inputted through the input section 110 from the operator (S120). As the determined result, if the stitch width correction signal is inputted, the auxiliary controller 130 first stores the stitch width correction signal on an internal memory, then sends the stitch width correction signal to the main controller 160 on the other hand. On the basis of the stitch width correction signal, the main controller 160 outputs a motor driving signal to the motor driver 170. The motor driver 170 forces the motor 180 to be turned in a forward or backward direction according to the motor driving signal, and thereby the reverse regulating lever shaft 32 (FIG. 7) rotates in a forward or backward direction.

To be more specific, when a progressive feed quantity (or feed quantity) A and a reverse feed quantity (or a condense quantity) B is inputted through the input section 110, the auxiliary controller 130 stores both feed quantities A and B on the internal memory. The auxiliary 130 rotates the motor 180 by the final feed quantity C (here, C=A+B) in a direction of an increase or decrease in the feed quantity. This rotating force is transmitted through the timing belt 190 to the reverse regulating lever shaft 32, so that the reverse regulating lever shaft 32 rotates.

Here, the sensor 185 detects rotation information on the reverse regulating lever shaft 32, and then outputs the detected rotation information to the main controller 160. The main controller 160 determines whether or not the reverse regulating lever shaft 32 is rotated by the final feed quantity C, and outputs the motor driving signal to the motor driver 170 so as to correct a rotational momentum of the motor 180.

Figure 1:
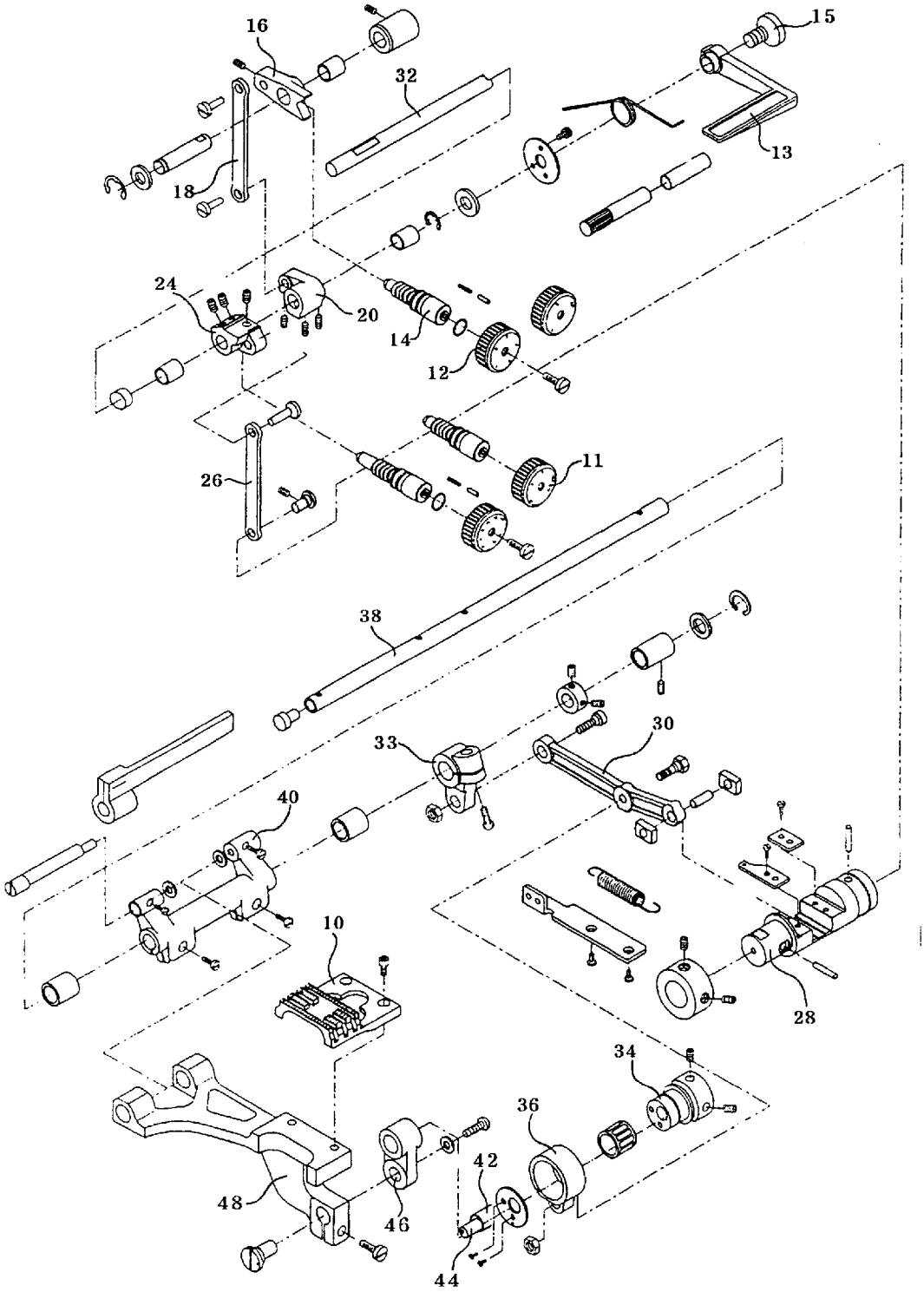
FIG. 1 PRIOR ART
FIG. 1 is an exploded perspective view showing an apparatus for controlling feed quantity and direction in accordance with the prior art.
Figure 2:
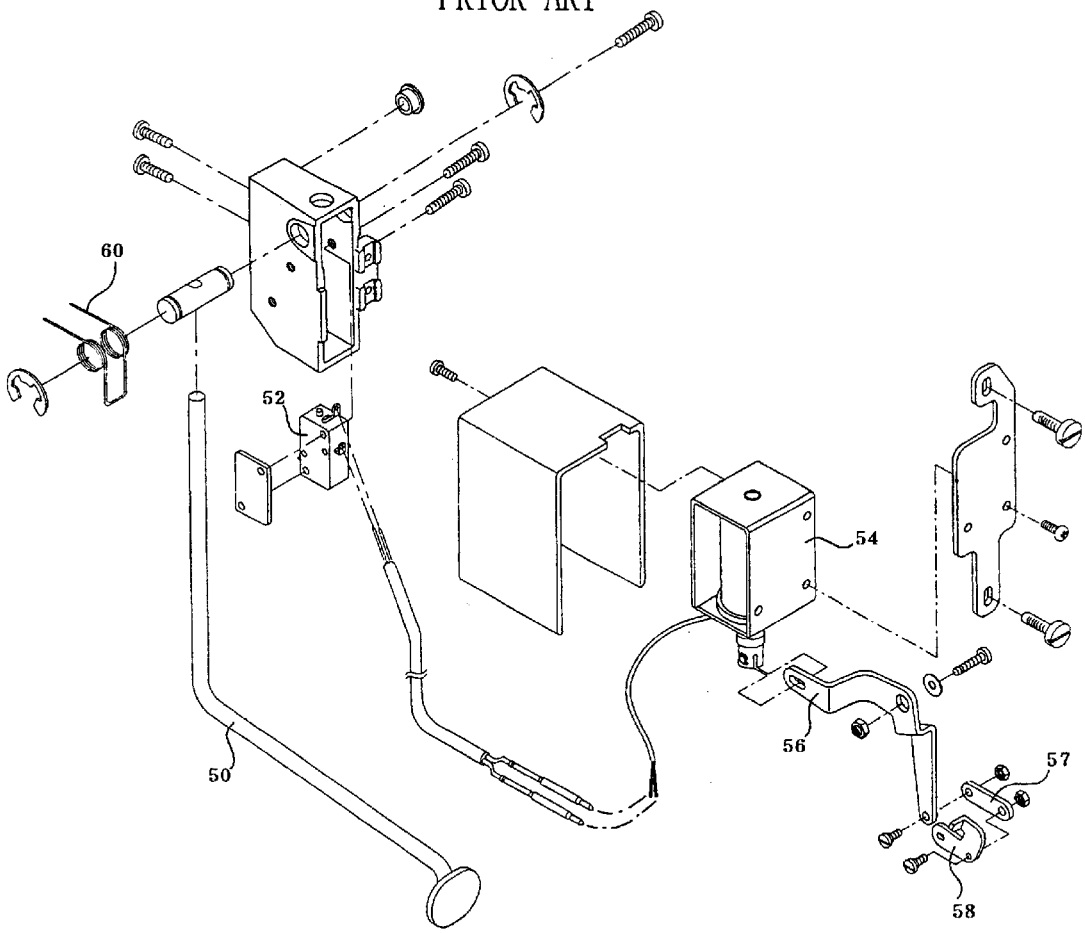
FIG. 2 PRIOR ART
FIG. 2 is an exploded perspective view for explaining a relationship between a reverse button and a reverse lever shown in FIG. 1.
Figure 3A:
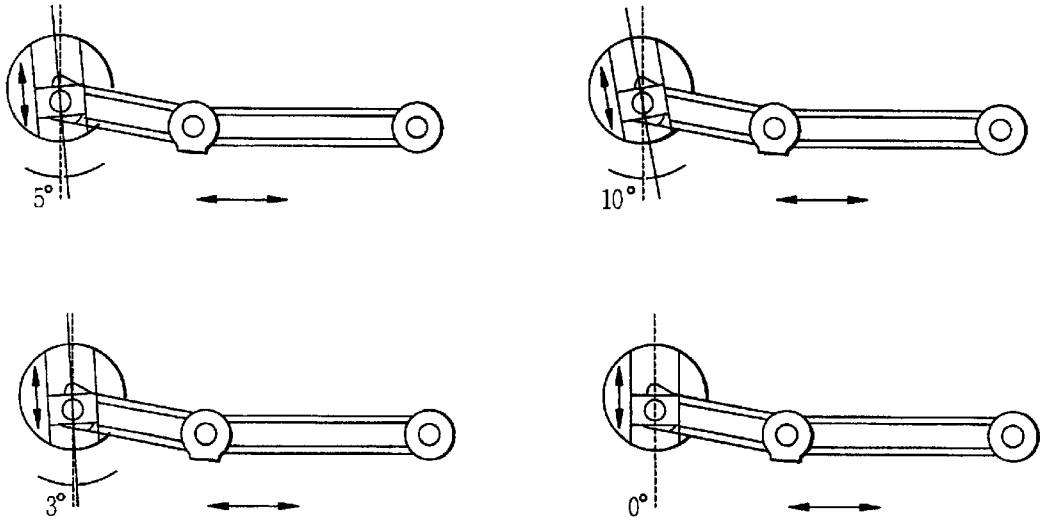
FIG. 3A PRIOR ART
FIGS. 3A and 3B show progressive and reverse motions of a feed regulator shaft connecting rod shown in FIG. 1.
Figure 3B:
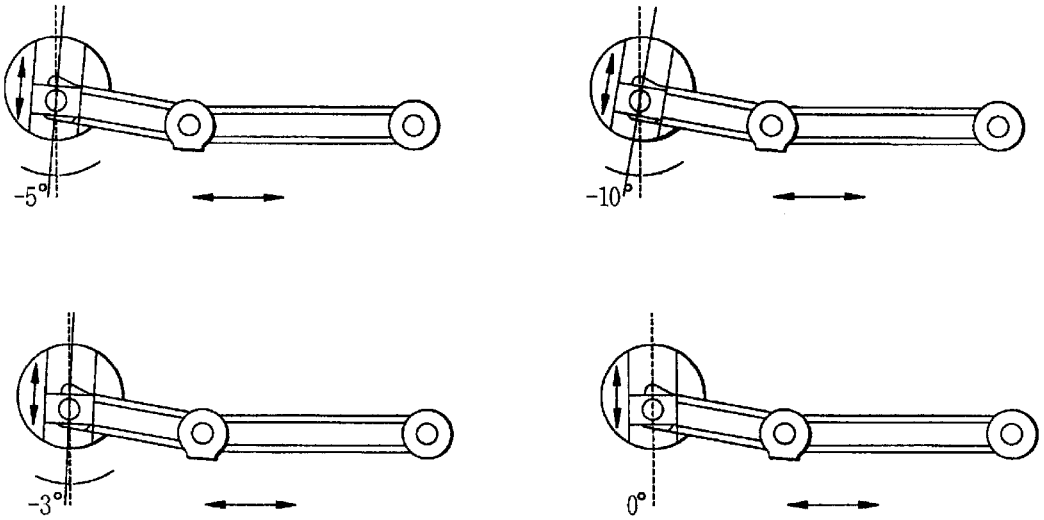
FIG. 3B PRIOR ART
Figure 4A:
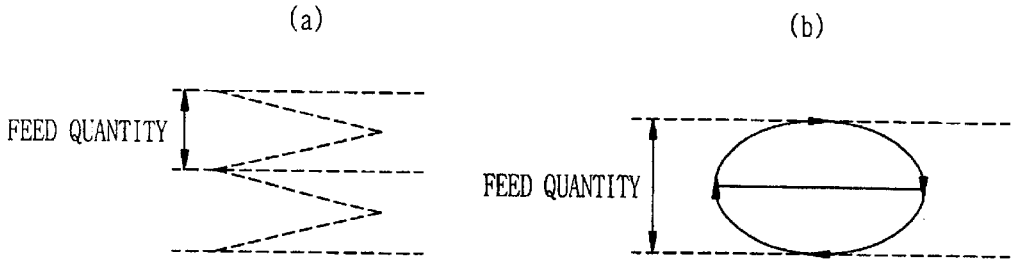
FIG. 4A PRIOR ART
FIGS. 4A to 4D show motions of a feed dog according to feed quantity.
Figure 4B:
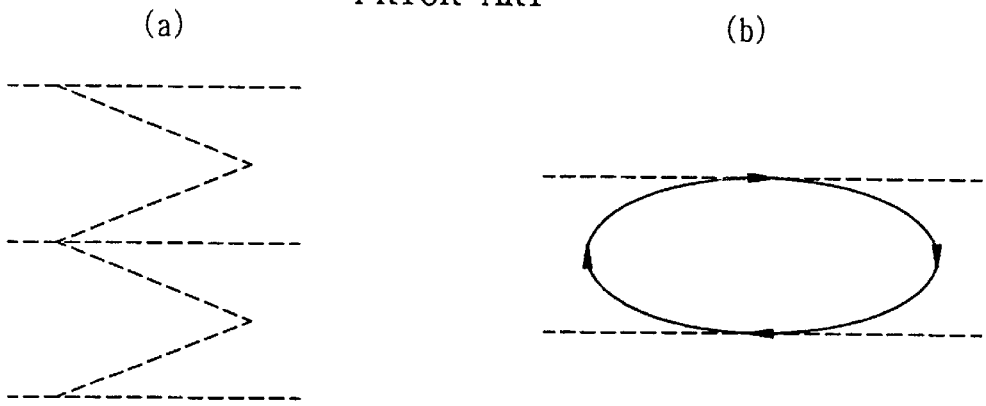
FIG. 4B PRIOR ART
Figure 4C:
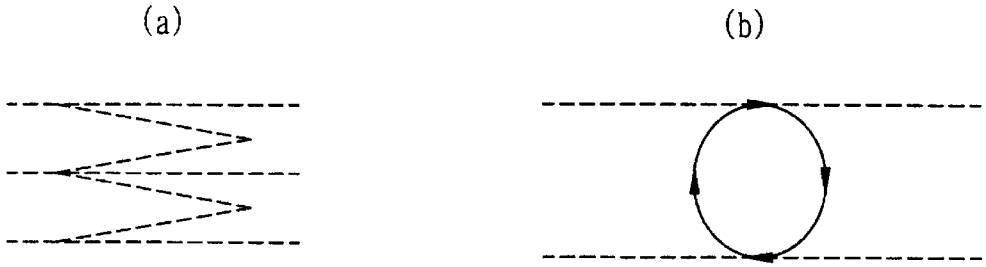
FIG. 4C PRIOR ART
Figure 4D:
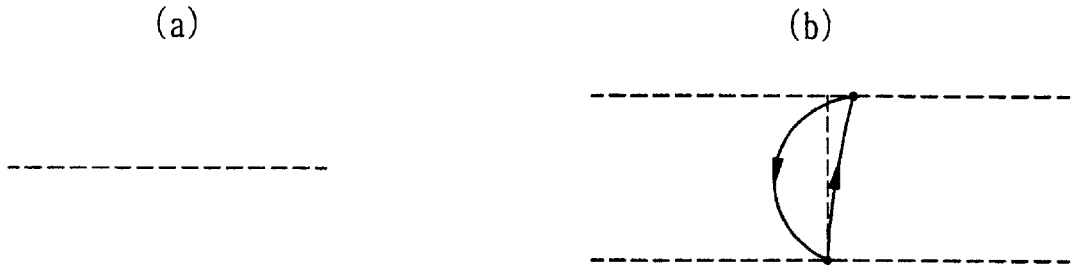
FIG. 4D PRIOR ART

Therefore, a rotational motion of the reverse regulating lever shaft 32 is transmitted through the condense regulator 24 to the feed regulator shaft 28, as illustrated in FIG. 1. The feed regulator shaft 28 maintains the stationary angle to an extent corresponding to the final feed quantity C, so that the stationary angle of the feed regulator shaft 28 changes as much as the final feed quantity C.

As a result, the sewing machine performs a sewing operation forming each stitch corresponding to the final feed quantity, before the operator inputs a different input value.

As the determined result in S120, if the stitch width correction signal is not inputted, the main controller 160 determines whether or not the operator has input a cancel signal (S130). If the operator inputs a cancel signal, the routine is terminated. However, if the operator does not input a cancel signal, the routine returns to S120.

In detail, when the motor 180 rotates to change the stationary angle of the feed regulator shaft 28, the final feed quantity is changed. When the stationary angle of the feed regulator shaft 28 changes to force a driving path of the feed cam connecting rod 36 to be changed, the feed direction is changed.

Meanwhile, the stitch width set as mentioned above may be freely corrected by the operator. To this end, the operator must select the correction set mode using the input section 110.

Hereinafter, a description will be made regarding a method for correcting feed quantity with reference to FIG. 9.

The auxiliary controller 130 determines whether or not a stitch width correction set mode is selected through the input section 110 (S200).

As the determined result in S200, if a stitch width correction set mode is selected, the auxiliary controller 130 checks whether or not a stitch width correction signal is inputted (S210). If a stitch width correction signal is inputted, a feed information signal related to the feed quantity is generated and outputted according to the stitch width correction signal. The main controller 160 outputs the motor driving signal for driving the motor 180 to the motor driver 170 according to the feed information signal.

Further, the auxiliary controller 130 outputs the stitch width correction signal to the display 140 so as to allow the operator to check the resultant (S240). Subsequently, the auxiliary controller 130 determines whether or not a motor position set signal is inputted (S250). As the determined result in S250, if a motor position set signal is inputted, the auxiliary controller 130 stores information on a stitch width correction and a motor position to the internal memory (not shown) based on the stitch width correction signal and the motor position set signal (S260), and updates existing information stored on the internal memory.

Subsequently, a description will be made regarding a method for controlling a feed direction. When the operator inputs feed quantities A and B (here, A=2.0 mm and B=1.0 mm) through the input section 110, the selector 120 is turned on. The auxiliary controller 130 recognizes that a sewing operation should be performed in a reverse direction, compares the feed quantities A and B with each other, and then outputs the motor driving signal through the main controller 160 to the motor driver 170 so as to enable the motor 180 to rotate on the basis of a rotational quantity of |3|, which corresponds to feed quantity of |A|+|B|.

The rotating force of the motor 180 is sequentially transmitted to the timing belt 190, the reverse regulating lever shaft 32, the condense regulator 24 and the feed regulator shaft 28. The feed regulator shaft 28 has a vertical angle to maintain the stationary angle corresponding to the reverse feed quantity of 1.0 mm. As an upper driving shaft rotates, stitches having a width corresponding to the reverse feed quantity of 1.0 mm are formed.

Alternatively, when the operator generates data such as table 1 and table 2 or performs an embroidery operation work after storing pre-programmed pattern data in the internal memory of the auxiliary controller 130, the motor 180 is controlled according to the position of the reverse regulating lever shaft (referred to Y direction feed quantity, that is condense quantity) and x-direction feed quantity so that the embroidery patterns as shown in FIGS. 10 and 11 are achieved.

TABLE 1

| L-stitch pattern | | | | | | | |
|---|---|---|---|---|---|---|---|
| Stitch sequence | 0 | 1 | 2 | 3 | 4 | 5 | 6 |
| Reverse regulating lever shaft position (mm) | 0 | 2 | 2 | 0 | 0 | 2 | 2 |
| x-axis shift quantity (mm) | 0 | 0 | 0 | 3 | −3 | 0 | 0 |

TABLE 2-1

| Radial pattern | | | | | | | | | |
|---|---|---|---|---|---|---|---|---|---|
| Stitch sequence | 0 | 1 | 2 | 3 | 4 | 5 | 6 | 7 | 8 |
| Reverse regulating lever shaft position (mm) | 0 | 2 | 2 | −2 | 2 | −1.5 | 1.5 | −1 | 1 |
| x-axis shift quantity (mm) | 0 | 0 | 0 | 1 | 0 | 1.5 | 0 | 2 | 0 |

TABLE 2-2

| Radial pattern | | | | | | | | | |
|---|---|---|---|---|---|---|---|---|---|
| Stitch sequence | 9 | 10 | 11 | 12 | 13 | 14 | 15 | 16 | ••• |
| Reverse regulating lever shaft position (mm) | −0.5 | 0.5 | 0 | 0 | 0.5 | −0.5 | 1 | 1 | ••• |
| x-axis shift quantity (mm) | 2.5 | 0 | 3 | 0 | 2.5 | 0 | 0 | 3 | ••• |

As can be seen from the foregoing present invention, feed quantity and direction of a workpiece are controlled by a motor in place of a mechanical mechanism, and thereby various patterns can be formed using stitches made up of upper and lower threads, and a sewing operation can be rapidly performed.

Further, the feed quantity and direction of the workpiece is controlled by one stitch, so that the various patterns can be more effectively achieved.

In addition, an operator can directly check the feed quantity of the workpiece through a display device such as an LED, instead of checking the feed quantity by seeing scales indicated on a mechanical dial, so that the operator can easily check the feed quantity.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. An apparatus for controlling feed quantity and direction in a sewing machine, the apparatus comprising:

an operator interface means for inputting the feed quantity and direction of a workpiece according to an operator's plan;

a motor driving control means for outputting a motor driving control signal according to feed information on the feed quantity and direction of the workpiece inputted through the operator interface means; and a workpiece feed control means for controlling rotation direction and speed of the motor according to the motor driving control signal from the motor driving control means.

2. An apparatus for controlling feed quantity and direction in a sewing machine as claimed in claim 1, wherein the sewing machine performs a sewing operation in a zigzag form while a needle bar reciprocates in an x-axis direction.

3. An apparatus for controlling feed quantity and direction in a sewing machine as claimed in claim 1, further comprising a sensing means for checking whether or not the motor is being driven and feeding the checked result back to the motor driving control means, so as to allow the motor driving control means to check whether or not the motor is being driven based on the feed information and to correct a driving condition of the motor.

4. An apparatus for controlling feed quantity and direction in a sewing machine as claimed in claim 1, wherein the operator interface means comprises:

an input section for inputting the feed quantity of the workpiece according to the operator's plan; a select section for inputting the feed direction of the workpiece according to the operator's plan; and a display section for displaying feed information on the workpiece inputted through the input and select sections on a screen.

5. An apparatus for controlling feed quantity and direction in a sewing machine as claimed in claim 4, wherein the feed quantity of the workpiece inputted into the input section includes at least one of a progressive feed quantity and a reverse feed quantity.

6. An apparatus for controlling feed quantity and direction in a sewing machine as claimed in claim 1, wherein the motor driving control means comprises:

a first control section for generating the feed information according to the feed quantity and direction of the workpiece; and a second control section for receiving the feed information by communicating with the first control section and outputting the motor driving control signal based on the feed information.

7. An apparatus for controlling feed quantity and direction in a sewing machine as claimed in claim 1, wherein the motor driving control means generates a control signal for converting a position of the motor into a reference position, before generating the control signal for converting the position of the motor in response to the feed information.

8. An apparatus for controlling feed quantity and direction in a sewing machine as claimed in claim 1, wherein the motor driving control means provides a correction set mode for allowing the feed information preset by the operator to be changed into desired feed information and restoring the changed resultant.

9. An apparatus for controlling feed quantity and direction in a sewing machine as claimed in claim 1, wherein the feed information is stitch width information.

10. A method for controlling feed quantity and direction in a sewing machine, the method comprising steps of:

recognizing feed quantity and direction of a workpiece inputted according to an operator's plan; and generating feed information on the feed quantity and direction of the workpiece and controlling rotation direction and speed of a motor in response to the feed information.

11. A method for controlling feed quantity and direction in a sewing machine as claimed in claim 10, further comprising a sensing step, the sensing step is carried out by sensing whether or not the motor is being driven, feeding the sensed result back to the controlling step, checking whether or not the motor is being driven based on the feed information, and correcting a driving condition of the motor.

12. A method for controlling feed quantity and direction in a sewing machine as claimed in claim 10, wherein the feed quantity of the workpiece inputted into the input section includes at least one of a progressive feed quantity and a reverse feed quantity.

13. A method for controlling feed quantity and direction in a sewing machine as claimed in claim 10, wherein the controlling step further comprising a step of converting a position of the motor into a reference position, before converting the position of the motor in response to the feed information.

14. A method for controlling feed quantity and direction in a sewing machine as claimed in claim 10, wherein the controlling step comprises a step of providing a correction set mode for allowing the feed information preset by the operator to be changed into desired feed information and restoring the changed resultant.

15. A method for controlling feed quantity and direction in a sewing machine as claimed in any one of claims 10 to 14, wherein the feed information is stitch width information.

* * * * *